US008464841B2

(12) United States Patent
Birrer et al.

(10) Patent No.: US 8,464,841 B2
(45) Date of Patent: Jun. 18, 2013

(54) METHOD AND APPARATUS FOR DETERMINING THE MOVEMENT AND/OR THE POSITION OF AN ELEVATOR CAR

(75) Inventors: Eric Birrer, Buchrain (CH); Daniel Arnold, Fluelen (CH)

(73) Assignee: Inventio AG, Hergiswil (CH)

( * ) Notice: Subject to any disclaimer, the term of this patent is extended or adjusted under 35 U.S.C. 154(b) by 369 days.

(21) Appl. No.: 12/976,051

(22) Filed: Dec. 22, 2010

(65) Prior Publication Data

US 2011/0147135 A1 Jun. 23, 2011

(30) Foreign Application Priority Data

Dec. 22, 2009 (EP) ..... 09180409

(51) Int. Cl.
*B66B 1/34* (2006.01)

(52) U.S. Cl.
USPC ..... 187/393; 187/305

(58) Field of Classification Search
USPC ..... 187/247, 277, 286, 287, 288, 305, 187/391–394
See application file for complete search history.

(56) References Cited

U.S. PATENT DOCUMENTS

| | | | | |
|---|---|---|---|---|
| 5,274,203 | A * | 12/1993 | Skalski et al. | 187/393 |
| 5,407,028 | A * | 4/1995 | Jamieson et al. | 187/288 |
| 5,648,645 | A | 7/1997 | Arpagaus et al. | |
| 5,747,755 | A * | 5/1998 | Coste et al. | 187/394 |
| 7,353,916 | B2 * | 4/2008 | Angst | 187/393 |
| 7,527,127 | B2 * | 5/2009 | Osterman et al. | 187/391 |
| 7,617,911 | B2 * | 11/2009 | Mattila et al. | 187/391 |
| 7,896,138 | B2 * | 3/2011 | Syrman et al. | 187/391 |
| 8,006,808 | B2 * | 8/2011 | Piedra et al. | 187/393 |
| 8,365,873 | B2 * | 2/2013 | Viita-Aho et al. | 187/393 |
| 2005/0269163 | A1 | 12/2005 | Angst | |
| 2008/0135342 | A1 | 6/2008 | Thumm | |

FOREIGN PATENT DOCUMENTS

EP 0712804 A1 5/1996

* cited by examiner

*Primary Examiner* — Anthony Salata
(74) *Attorney, Agent, or Firm* — Fraser Clemens Martin & Miller LLC; William J. Clemens

(57) ABSTRACT

A method and apparatus for determining the movement and/or the position of an elevator car include a first monitoring unit for analyzing first signals of a first sensor device for obtaining information about the movement and/or the position of the elevator car, for detecting a possible faulty behavior of the elevator system, and for initiating corresponding safety measures. A second sensor device, which does not operate on the principle of the first sensor device, registers changes of the movement state of the elevator car and emits corresponding second signals to a second monitoring unit that analyzes the second signals and detects changes of the movement state of the elevator car. A fault signal is generated if the movement signals that are obtained from the first monitoring unit are incoherent with the changes of the movement state of the elevator car that are detected by the second monitoring unit.

20 Claims, 5 Drawing Sheets

DRIVE UNIT
SENSOR
33
14
13
12
5
1
CONTROL UNIT
INFORMATION SYSTEM
511
521
6
7
SENSOR
321
S33
$t_{REF}$
MONITORING APPARATUS
4
S32
32
43
MONITORING UNIT TIME BASIS
S31
31
$t_{REF}$
41
$t_{REF}$
42
S-51
2
S-51F
S-52
S-43
F43
F42
44
SAFEGUARDING MODULE
11
9
51
52

METHOD AND APPARATUS FOR DETERMINING THE MOVEMENT AND/OR THE POSITION OF AN ELEVATOR CAR

FIELD OF THE INVENTION

The invention relates to a method and an apparatus for determining the movement and/or the position of an elevator car of an elevator system, in particular to detection of a possible faulty behavior of the elevator system.

BACKGROUND OF THE INVENTION

In an elevator system, the movement and the position of an elevator car are registered by means of sensor devices. Typically foreseen in such cases is that also a possible faulty behavior of the elevator system, for example the occurrence of overspeed of the elevator car, is detected, so that the required safeguarding measures can be initiated.

A method and an apparatus for measuring the speed, and for detecting overspeed, in an elevator system are described in EP 0 712 804 A1. By means of this known apparatus, the travel speed of an elevator car that is guided in an elevator hoistway, and driven by a drive unit, is monitored, so as to bring it to a standstill should overspeed occur.

To this end, fastened to a wall of the elevator hoistway is a measuring strip, which is scanned by a fork-light-barrier that is connected to the elevator car. The measuring strip has a measuring track with vanes, with the aid of which the speed of the elevator car is measured. Consequently, by comparing the measured speed with the specified maximum speed, the possible occurrence of overspeed can be detected and signaled. The respective length of the vanes is adapted to the maximum speed of the elevator car in the corresponding area of the hoistway, i.e. towards the upper and lower ends of the hoistway, the vane segments become increasingly shorter. The scanning duration of the individual vanes therefore remains at an at least approximately constant limit value, provided that the entire hoistway area is traveled through with the foreseen maximum speed. Should the duration of the scanning of an individual vane be shorter than this limit value, an impermissible exceeding of the maximum speed has occurred.

The measuring strip further has a control track with window openings, each of which is assigned to, and arranged at the same height as, a vane. Provided that the measuring strip and the fork-light-barrier are correctly installed, the markings of the measuring track, and of the control track, will be correctly scanned. Hence, by scanning the window openings of the control track, it is checked whether the fork-light-barrier engages sufficiently deeply in the measuring strip, and whether the sequential interruption of the light-barrier, or usually a plurality of light-barriers, by the vanes during travel of the elevator car is assured. Through scanning of the control track, it can further be determined whether individual vanes on the measuring strip are missing, as a result of which the speed measurement would be falsified. The vanes of the measuring track, and the window openings of the control track, are dimensioned and arranged in such manner that always at least one light-barrier is interrupted. Hence, should the light-barriers that are assigned to the measuring track and the control track be simultaneously uninterrupted, a fault is present, such as occurs, for example, if the fork-light-barrier has separated from the measuring strip.

In a preferred embodiment of this known apparatus, the measuring strip has, in addition to the measuring track and the control track, a safety track, which serves to additionally monitor the elevator car in the upper and lower end-areas of the elevator hoistway.

The fork-light-barrier has further a first and a second optical channel with mutually independent light-barriers, whose signals are input to a first and a second measurement channel. Should the measurement results of these two measurement channels differ from each other, a fault is detected, which is attributable, for example, to failure of an individual optical component.

Despite these many and diverse safeguarding measures, under certain circumstances also in this apparatus, faults can occur which endanger the safe operation of the elevator system. For example, identical faults can occur in both channels of the fork-light-barrier. Further, damage to the measuring strips, or permanent effects of extraneous matter, can occur. Should the aforementioned impairments in the fork-light-barrier of the measuring strip occur, the markings of the measuring strip are no longer correctly scanned, as a result of which, correct measurement of the speed, and hence also detection of an overspeed, are no longer possible.

Also, under certain circumstances, the indicated states do not contain any direct, unequivocal information as to the true state of the elevator system. For example, a state can occur in which all of the light-barriers are interrupted by the measuring strip. This state can continue for a relatively long period of time, if the elevator car is brought to a standstill at a corresponding position inside the elevator hoistway. The same state can, however, also occur if the elevator car is traveling and one of the aforementioned faults occurs. Based on the available information, it is therefore not possible to determine unequivocally whether the elevator car is at a standstill at a certain position, or whether it is moving along the elevator hoistway.

SUMMARY OF THE INVENTION

It is therefore the task of the present invention to propose a method and an apparatus for reliably determining the movement and/or the position of an elevator car of an elevator system by means of which the shortcomings described above are avoided. Further, an elevator system that is provided with this apparatus, and operates according to this method, shall be proposed.

The method and the apparatus which, in particular, shall permit reliable detection of a faulty behavior of the elevator system, in particular of an overspeed, shall be realizable with simple means, and result in a significant improvement in the reliability of the monitoring of the elevator system.

The method and the apparatus that serve to reliably determine the movement, and/or the position, of an elevator car of an elevator system have a first monitoring unit, by which first signals of a first sensor device are analyzed to obtain information about the movement and/or the position of the elevator car, and to detect a possibly occurring faulty behavior of the elevator system, and to initiate corresponding safety measures, which, for example, relate to the opening of safety-switch elements and thereby the bringing the elevator to a standstill.

According to the invention, a second sensor device is foreseen, which does not operate on the principle of the first sensor device, by means of which changes in the movement state of the elevator car are registered, and corresponding second signals issued to a second monitoring unit, which analyzes the second signals and detects changes in the movement state of the elevator car, whereupon a check is performed as to whether the movement signals that are obtained from the first monitoring unit are coherent with the changes in the movement state of the elevator car that are detected by the second monitoring unit. In case of incoherence, a first fault signal is generated.

Through the verification of the coherence of the measurement results of mutually independently functioning first and second monitoring units, a clearly higher reliability of the determination of the movement and/or of the position of the elevator car and, in particular, of a possible faulty behavior, in particular of an impermissible overspeed, of the elevator system is achieved. If the first monitoring unit determines, for example, the speed of the elevator car with the aid of an optical first sensor device, anomalies that occur there as described above are not relevant for an electromechanical second sensor device, with the aid of which the second monitoring unit registers the occurrence of changes in the movement state of the elevator car. Conversely, anomalies that can possibly occur in the electromechanical second sensor device are virtually insignificant for the optical first sensor device, The two monitoring units therefore operate on different principles, or in different technical sub-areas, as a result of which, a comparison of the respective work-results produces a higher information yield than is obtained from a comparison of additionally-obtained measurement parameters in the same technical area. Hence, in the object of EP 0 712 804 A1, in a preferred embodiment, in addition to the measuring track and the control track, a securing track is provided, whose scanning delivers additional information. On the other hand, scanning of all three tracks can be simultaneously impaired by the same cause. For example, all three tracks can be covered with extraneous matter. Furthermore, all of the light sensors can be simultaneously disturbed by extraneous light, or all of the light sensors can be covered with extraneous matter. It is further to be expected that, on damage to the measuring strip, all three tracks are damaged, which is why augmentation with an additional track that is also optically scanned does not bring the desired improvement.

In the apparatus according to the invention, the system-determined decoupling of the first and second sensor devices results in a reduced susceptibility to simultaneously occurring faults. Provided that the first and second monitoring units are also sufficiently electrically decoupled, with low outlay the solution according to the invention results in a significantly higher gain in safety. Mutual checking by the first and second monitoring units therefore allows any faults to be promptly detected, and the elevator system to be protected from endangerment.

Despite the different functional principles, there is a direct relationship between, on the one hand, the measurement parameters that are determined by the first sensor device and the first monitoring unit and, on the other hand, the measurement parameters that are determined by the second sensor device and the second monitoring unit, which both relate to the movement of the elevator car, which allows cross-checking of the two monitoring units.

For mutual checking by the first and second monitoring units, it is already sufficient to monitor the interrelated, or coherent, occurrence of mutually corresponding signals of the two monitoring units. If the elevator car is accelerated, the first, for example optical, sensor device, which is guided along a stationarily held measuring strip, and the second, electromechanical, sensor device emit mutually corresponding, respectively first and second, signals, provided that both sensor devices are correctly functioning and hence operating with mutual coherence. A check as to whether, on occurrence of first signals that signal a movement, or a change of movement, of the elevator car, also second signals occur, which also signal a corresponding change in movement of the elevator car, therefore allows verification that both monitoring units, and the associated sensor devices, are operating correctly. For the check, various signals can be used that indicate interrelated states. Furthermore, it is also possible in both monitoring units to calculate kinematic parameters and compare them with each other.

For this purpose, it is not necessary for the respective signals of the two monitoring units that signal movements, or changes of movement, of the elevator car, to occur simultaneously. Because of different physical measurement principles, and different measurement circuits, the mutually corresponding measurement signals typically occur with a mutual time delay, which can also vary within a certain range. Therefore, in preferred embodiments, at least one time-window is provided, within which the occurrence of two mutually corresponding signals or messages from both monitoring units is monitored. Typically, the time-window is opened after a corresponding signal has been detected in one of the monitoring units.

In a preferred embodiment, the second sensor device contains at least one electromechanical movement sensor, such as an acceleration sensor and/or a speed sensor. An acceleration sensor is normally a measurement sensor that is provided with a test mass, with which the acceleration is measured, in that, on occurrence of an acceleration or a deceleration, the inertia force that acts on the test mass is determined. The acceleration that acts on the test mass due to the earth's gravity is preferably compensated electrically or electronically, so that the signals that are emitted by the acceleration sensor indicate the additional accelerations that are acting on the acceleration sensor, which are typically attributable to the effects of the drive apparatus and the brake apparatus. Known from Tietze-Schenk, Halbleiter-Schaltungstechnik, Springer-Verlag, Heidelberg 1999, 11th edition, page 1223, is an acceleration sensor in which the test mass acts on a membrane that is provided with strain gauges. Further, a capacitively-acting or inductively-acting sensor can be used as an acceleration sensor, in that the test mass is suspended spring-elastically and acts as part of a capacitor, or as a magnet inside a coil. Also known are piezoelectric acceleration sensors. A speed sensor can, for example, have a follower-wheel, which rolls in the elevator hoistway and is coupled to a measurement transducer. Such electromechanical sensors hence operate according to different principles than the optical sensors that are known from EP 0 712 804 A1, which, in the present invention, are preferably used in the first sensor device. Alternatively or additionally, the second sensor device contains a measurement-value transducer, which detects causes that result in a subsequent change in movement of the elevator car.

With the aid of the second sensor device, signals are generated that relate to changes in the movement state of the elevator car, which, within a correspondingly chosen time-window, are compared with corresponding signals from the first sensor device, to determine whether the measurement results are coherent.

The size of the time-window is preferably chosen depending on the foreseen speed of the elevator car, the signals that are to be compared, and the measurement and analysis method that is used. Provided that a change in movement has already occurred and been detected by the acceleration sensor, the time-window is chosen correspondingly small. On the other hand, if, in the drive and/or brake apparatus, a control command for putting the system into operation has been detected, the time-window is chosen correspondingly larger. When choosing the size of the time-window, the measurement method that is used is also taken into account. When using the fork-light-barrier described at the outset, the time-window is chosen according to the distances between the markings of the measuring strip.

Preferably, the first sensor device is a light-barrier device that is mounted on the elevator car, which has first optical elements, which serve to form at least a first light-barrier, with the aid of which, during the travel of the elevator car, at least the markings of a measurement track of a measuring strip are scanned, which is mounted stationarily in the elevator hoistway. From the first signals that are emitted by the first sensor device, in the monitoring unit the first activating signals are determined. When light-barriers are used, flank transitions, or movement signals, occur within the signal pattern, which indicate closing or opening of the light-barrier, and hence the movement of the elevator car. The time interval between these movement signals is inversely proportional to the speed of the elevator car. If an acceleration of the elevator car out of the stationary state, or out of a travel with constant speed, has been determined by the second monitoring unit, within a correspondingly chosen time-window, the opening, or an interruption, of the light-barrier, and thus a corresponding movement signal, must be determined by the first monitoring unit. Through the checking of the arrival of the movement signal, the coherent operation of the two monitoring units can thus be verified.

In a further preferred embodiment, the second signals that are emitted by the acceleration sensor, and/or by the speed sensor, and/or by the measurement-value transducer, are analyzed to determine impermissible operating states, such as acceleration values above a limit value, or speed values above a limit value, or drive values outside a tolerance range, a second fault signal being generated after values are obtained that lie above a limit value, or outside the tolerance range. Faulty functions can thus be promptly detected by reference to the second monitoring unit, possibly before an overspeed occurs and is detected by the first monitoring unit. In this case, therefore, not only the correct functioning of the first monitoring unit is monitored independently by the second monitoring unit, but also the behavior of the elevator system.

In further preferred embodiments, the first and/or second sensor device, as well as the first and/or second monitoring unit, are embodied at least partly redundantly. The output signals of mutually corresponding redundant parts of this apparatus are compared with each other, a third fault signal being generated should a difference occur.

The first sensor device, and at least a part of the second sensor device, are preferably arranged in a common housing. By this means, a compact construction of the sensorics is possible. Preferably, at least the acceleration sensor is constructed as a micro-electromechanical system (MEMS) and, for example, cast in the housing of the two sensor devices. Corresponding micro-electromechanical sensor devices, which can be integrated in the housing of the first sensor device without problem, are, for example, described in WO 2009117687 A1.

Like the sensorics of the first sensor device, also the sensorics of the second sensor device are preferably constructed redundantly, or multichanneled, so that, through a comparison of the signals of the various channels, a fault can be recognized. Preferably, also the singly-embodied or redundantly-embodied first and/or second monitoring unit are/is integrated in the common housing of the sensor devices. In this manner, an overall more compact and less expensive construction of the entire monitoring apparatus results, which can be realized, for example, in the form of a fork-light-barrier. In a preferred embodiment, two such fork-light-barriers that are mutually separated, or mutually connected, are used.

By use of the apparatus according to the invention, not only the overspeed of an elevator car be reliably detected. It can also be determined whether a standstill of the elevator car that is signaled by the first monitoring unit has actually occurred. If, during travel of the elevator car, a fault as described above occurs in the first monitoring unit, in the first sensor device, or in the measuring strip, it is possible that no more movement signals from the first monitoring unit arrive. This could be interpreted as the start of the stationary state of the elevator car, even though the latter is, in fact, still traveling. Also here, the checking according to the invention of the coherence of the measurement results of the first and second monitoring units, allows the said faults to be detected. If, after the elevator car has been traveling, a stationary state is signaled by the first monitoring unit, it is checked whether also from the second monitoring unit a corresponding change of movement, in particular an acceleration opposite to the direction of movement of the elevator car, is detected, and thus coherence prevails.

If, during travel of the elevator car, a change in movement is detected in one of the two monitoring units, preferably, the size of the time-window is correspondingly adjusted, within which a coherent confirmation of the change in movement is expected from the other monitoring unit. This allows determination not only of whether the two monitoring units are in operation, but also of whether they are functioning correctly.

The method according to the invention can therefore be advantageously used to check changes in state of the elevator system, as well as the state of monitoring devices and control devices.

The monitoring apparatus, or at least the monitoring units that are provided therein, are preferably connected to the central control unit of the elevator system, and/or to a hoistway information system, which registers position data, and/or movement information, of the elevator car and transmits it to the control unit.

The exchange of information and signals between the sensor devices and the monitoring units, as well as the control unit and the hoistway information system, can take place by means of wireless or hard-wired transmission apparatus, or a combination of both.

Further, also other information and signals, such as position signals and RFID signals, that reflect the status of the elevator system, can be processer alternatively or complementarily by the second monitoring unit. With the aid of deeper-level information, it is possible to optimize the measurement results further. For example, the tolerance ranges, e.g. the time-window, can be reduced, should the hoistway information system indicate that the elevator car is situated in the lower, or upper, end-area of the elevator hoistway.

DESCRIPTION OF THE DRAWINGS

The invention is explained in greater detail below with the aid of several exemplary embodiments by reference to the attached figures. Shown are.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
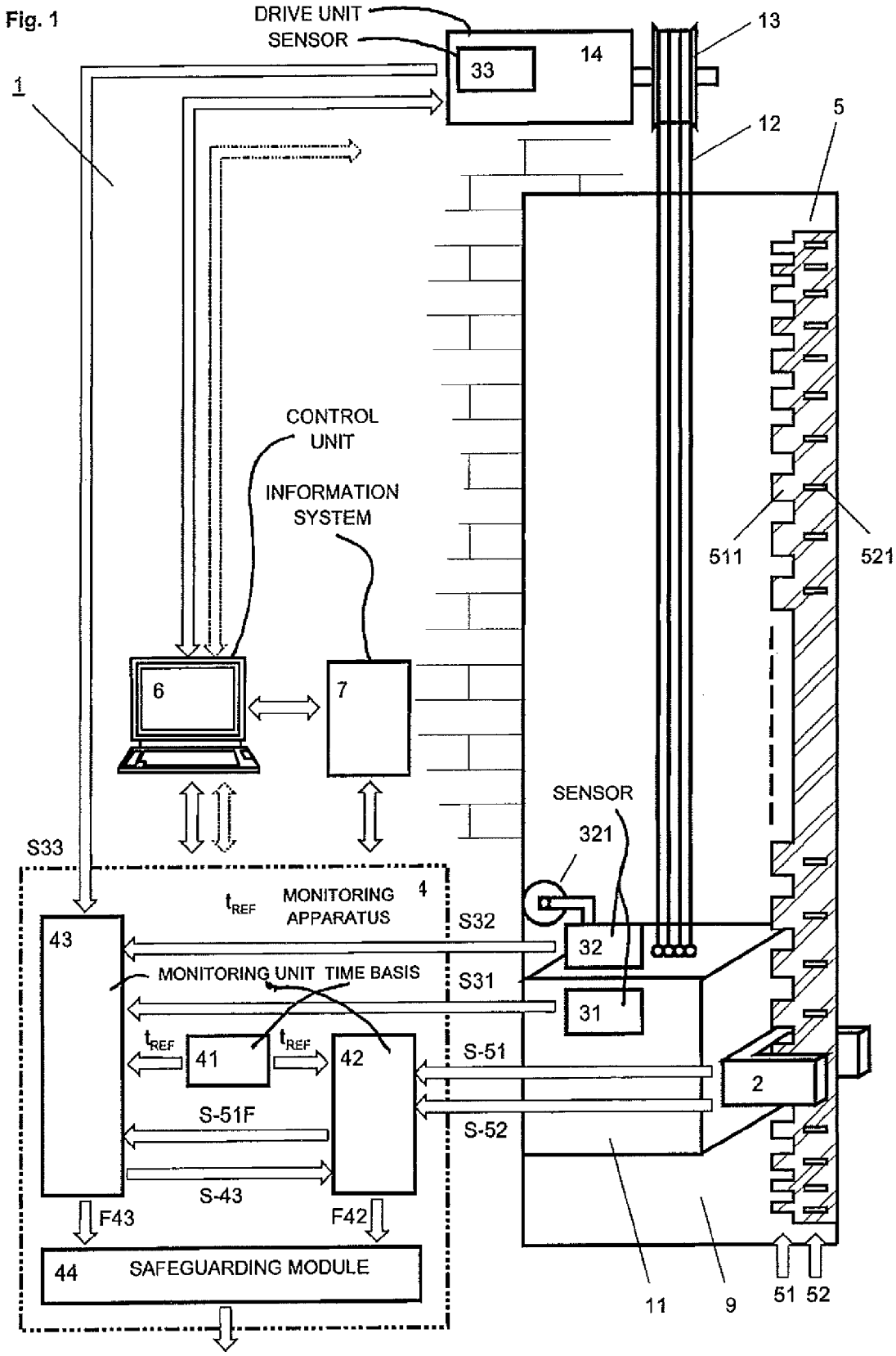
FIG. 1 is a diagrammatical illustration of an elevator system according to the invention, which has a monitoring device, with a first and a second monitoring unit, which are coupled with sensor devices, with the aid of which the movements of an elevator car, that is vertically movable in an elevator hoistway, can be registered in various ways.

FIG. 1 shows a diagrammatic illustration of an elevator system 1, which has an elevator car 11 that can be moved vertically in an elevator hoistway 9, which, via ropes 12 and a traction sheave 13, is connected to a drive unit 14. The elevator system 1 is further provided with an apparatus according to the invention, by means of which the speed, and any overspeeds, of the elevator car 11 can be registered. The apparatus according to the invention is constructed in such manner that a fault occurring therein can be reliably detected, and the elevator system 1 correspondingly safeguarded. The apparatus according to the invention contains a monitoring apparatus 4, in which two mutually independent monitoring units 42, 43 are provided, to which, in this preferred embodiment, a reference frequency $t_{REF}$ of a commonly used time basis 41 is applied.

Figure 2:
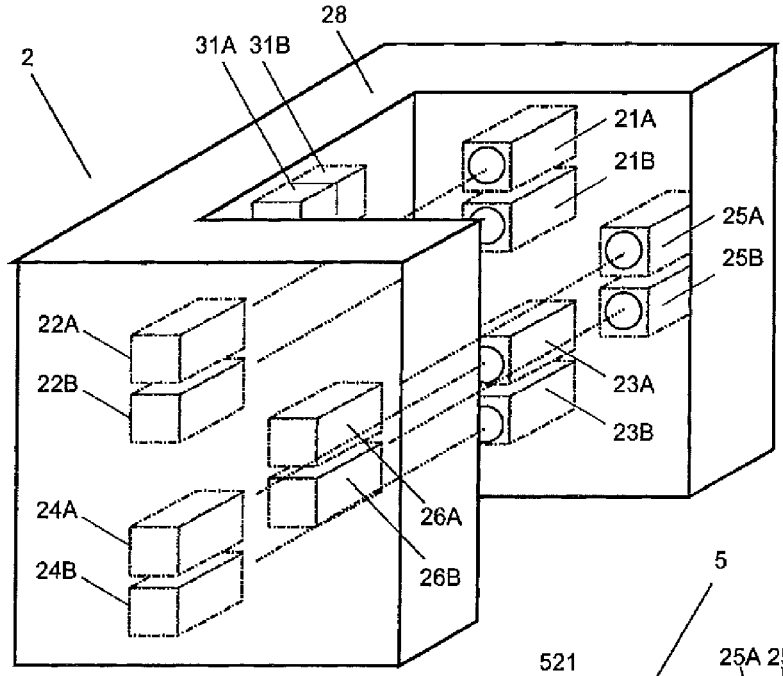
FIG. 2 is a perspective view of the fork-light-barrier that is shown in FIG. 1.

The first monitoring unit 42 is connected to a sensor device 2, which is shown in FIG. 2, and, in the embodiment shown, corresponds to the fork-light-barrier 2 that is known from EP 0 712 804 A1. This fork-light-barrier 2 is constructed two-channeled, and contains paired optical elements, viz. transmitters 21A, 23A, 25A and receivers 22A, 24A, 26A for the first channel, and transmitters 21B, 23B, 25B and receivers 22B, 24B, 26B for the second channel, with the aid of which light-barriers $LS_{MB-A1}$, $LS_{MB-A2}$, $LS_{KB-A}$ for the first channel, and light-barriers $LS_{MB-B1}$, $LS_{MB-B2}$, $LS_{KB-B}$ for the second channel, are formed. The measurement signals that are generated with the aid of the light-barriers of the two channels A and B are processed independent of each other and, in the first sensor device 2, or in the first monitoring unit, can be compared with each other with the aid of a comparator to detect faulty functions. For the discussion that follows, it is sufficient to consider the first and the third light-barriers of the first channel.

The fork-light-barrier 2 is, for example, arranged on the elevator car 11 in such manner that it embraces on one side a measuring strip 5, which is aligned vertically, and mounted stationarily, in the elevator hoistway 9. During travel of the elevator car 11, the fork-light-barrier 2 scans the markings 511, 521 of a measuring track 51, and a control track 52, which run parallel to each other along the measuring strip 5. The measuring track 51 has the markings 511 in the form of exposed vanes, whose width reduces towards the end-areas of the elevator hoistway 9, in which a constantly reducing maximum speed is specified. On account of the adaptation of the width of the markings 511 of the measurement track diagrammatical to the maximum speed of the elevator car 11, in a trip at maximum speed, the flanks of the markings 511 of the first light-barrier $LS_{MB-A1}$ that is provided for this purpose are constantly traveled over in time intervals of equal length. Also in this case, almost constant time intervals occur between the respective flanks of the signals that are emitted by the fork-light-barrier 2. At the maximum speed of the elevator car 11, these constant time intervals assume a minimum value, which is selected as limit value. If this minimum value, or limit value, is fallen below, an overspeed is occurring. In this case, a fault signal F42 is emitted by the first monitoring unit 42 to a safeguarding module 44, which consequently triggers, for example, the opening of safety-switch elements, and brings the elevator car 11 to a standstill, as described in EP 0 712 804 A1. With the aid of the second light-barrier $LS_{MB-A2}$, which also scans the measuring track 51, it is determined whether a marking 511 was passed, or only touched.

In the control track 62, at the height of the markings 511 of the measurement track, window openings 521 are provided, which are scanned by means of the third light-barrier $LS_{KB-A}$ of the fork-light-barrier 2. If the control track 52 is correctly scanned, there is assurance that the measuring strip 6 engages sufficiently deeply in the fork-light-barrier 2. On the other hand, if the respective signals from the third light-barrier $LS_{KB-A}$ fail to appear, a further fault signal is emitted to the safeguarding module 44.

Figure 3:
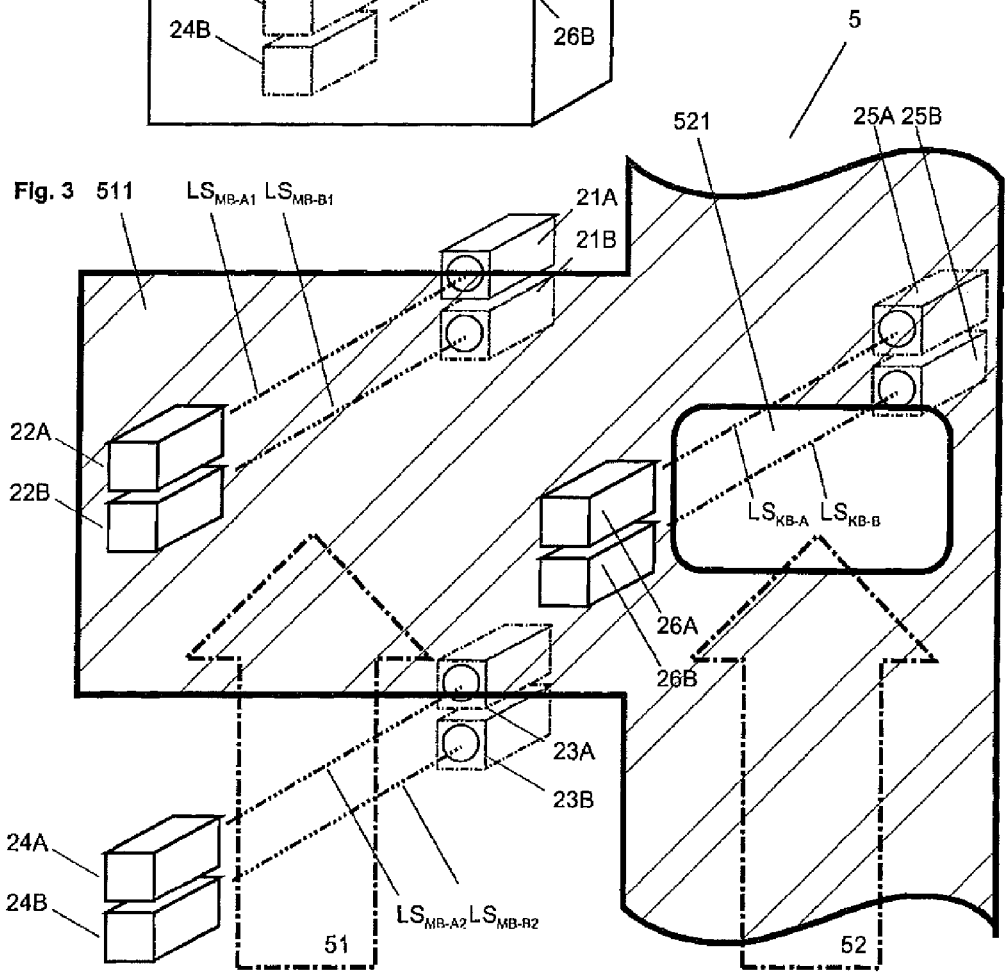
FIG. 3 is diagrammatical view of a measuring strip, with a measuring track and a control track, which are scanned by light-barriers which are formed from optical elements of the fork-light-barrier of FIG. 2.

Scanning of the measuring track 51, and of the control track 52, of the measuring strip 5 is shown in FIG. 3. It can be seen that each marking 511 of the measuring track 51 is situated opposite a window-opening 521 of the control track 52. The width of the markings, or vanes 511, of the measuring track 51 is greater than the width of the window openings 521, which assures that in normal operation always the first or third light-barrier $LS_{MB-A1}$, $LS_{KB-A}$ of the fork-light-barrier 2 is interrupted. If the first and third light-barriers $LS_{MB-A1}$, $LS_{KB-A}$ are opened simultaneously, a fault is detected.

Figure 4:
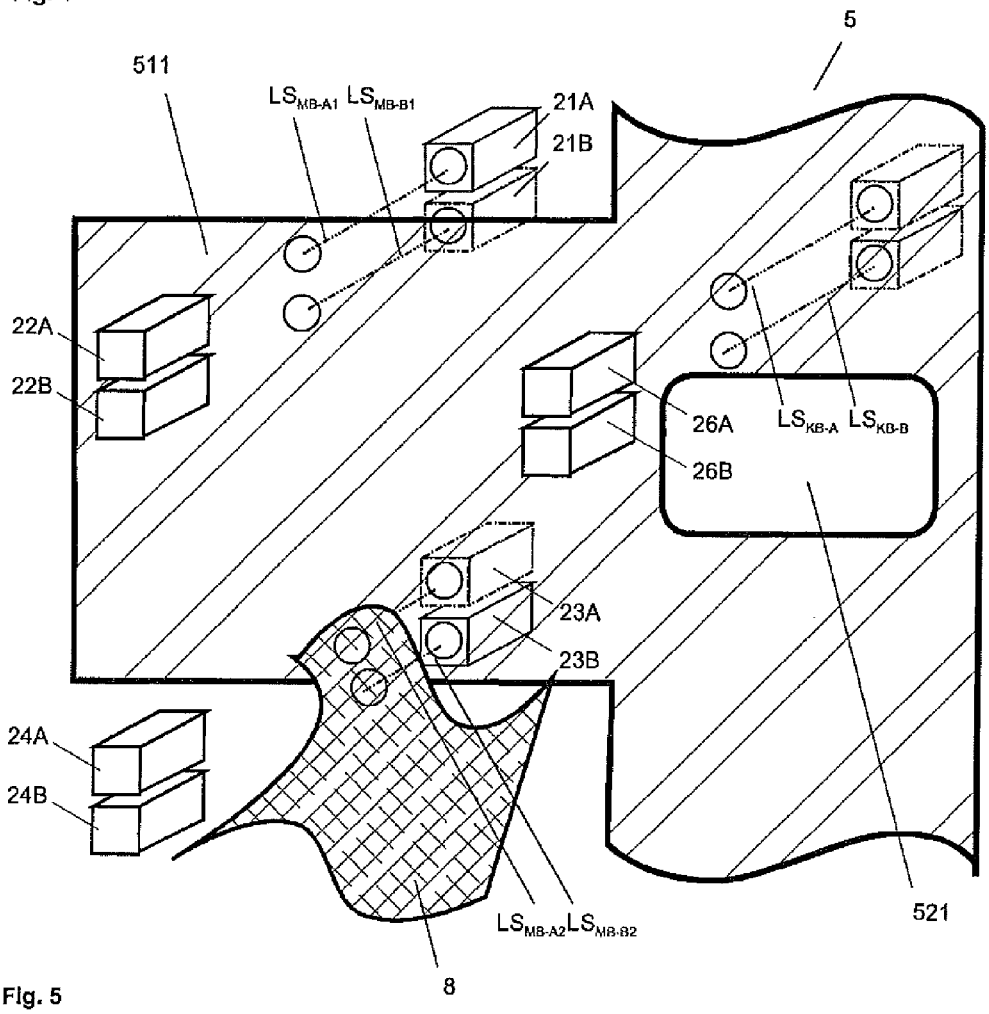
FIG. 4 is a diagrammatical view of the light-barriers of the fork-light-barrier of FIG. 3, which are interrupted on the one hand by the measuring strip, and on the other hand at least partly by extraneous matter.

As shown in FIG. 4, a state is also permissible in which both the first, and also the third, light-barrier $LS_{MB-A1}$, $LS_{KB-A}$ of the fork-light-barrier 2 are interrupted. This state, which, should the elevator car 11 come to a standstill at a particular position, can last for a relatively long time, is hence not interpreted as a fault. However, as illustrated in FIG. 4, this state can, in fact, be erroneous, and caused, for example, by extraneous matter 8. Further, a defect of an optical element 21A, 23A, 25A or 22A, 24A, 26A, or a defect in the first monitoring unit 42, can cause the said state. This state is therefore not unequivocal, in consequence of which, corresponding dangers result.

Figure 5:
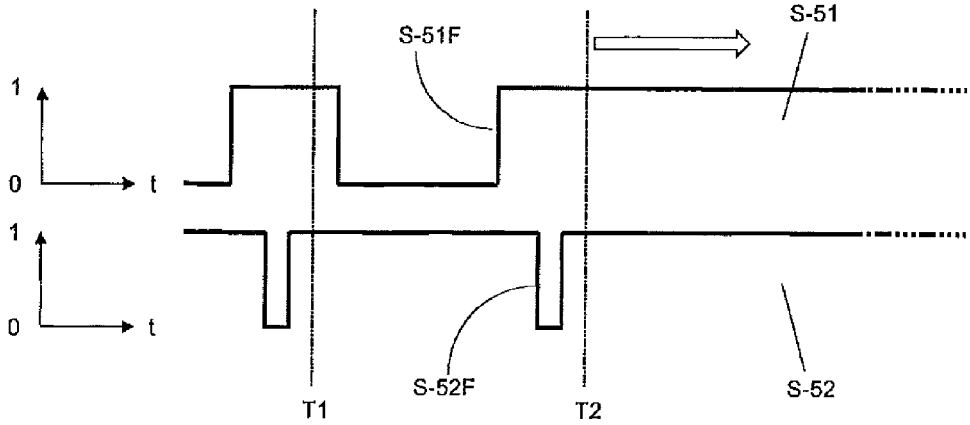
FIG. 5 is a waveform diagram with the pattern of the signals of the fork-light-barrier of FIG. 3, which shows that, after an instant T2, the corresponding light-barriers and are closed, and that therefore either the elevator car has been halted at a certain position, or a fault has occurred.

FIG. 5 shows a diagram with signals S-51, S-52 of the fork-light-barrier 2, from which it can be seen that, at the instants T1 and T2, the respective light-barriers $LS_{MB-A1}$ and $LS_{KB-A}$ are closed. At the instant T1, both light-barriers $LS_{MB-A1}$ and $LS_{KB-A}$ are closed, and subsequently opened again, by the measuring strip 5, so that, in the first monitoring unit 42, two of each flank signal S-51F and S-52F are detectable. After instant T2, the light-barriers $LS_{MB-A1}$ and $LS_{KB-A}$ remain permanently closed, so that either the elevator car has been brought to a standstill at the position shown in FIG. 4, or a safety-relevant fault has occurred.

To eliminate this problem, the monitoring apparatus 4 has a second monitoring unit 43, which is connected to a second sensor device 31, 32, 33, by means of which the changes in the movement state of the elevator car 11 are registered, and corresponding second signals S-31, S-32, S-33 are issued to the second monitoring unit 43.

In the present embodiment, the second sensor device 31, 32, 33 contains an acceleration sensor 31 and a speed sensor 32, which are connected to the elevator car 11. The acceleration sensor 31 can act according to one of the principles described above. The speed sensor 32 has a measurement transducer, which is coupled to a follower-wheel 321 that is guided along the hoistway wall, for example in a rail. From the two electromechanical movement sensors 31, 32, signals S-31; S-32 are emitted, which signal the changes in the movement state of the elevator car 11. Further, the second sensor device contains a measurement-value transducer 33, which is connected to the drive apparatus 14, and preferably also to the brake apparatus 33, from which signals are monitored that indicate the initiation of changes in movement of the elevator car 11. The signals S-31; S-32; S-33 of the second sensor device 31, 32, 33 are therefore analyzed by the second monitoring unit 43, to determine changes in the movement state of the elevator car 11 which have occurred, or are expected to occur.

After detection of a change in the movement state of the elevator car, possibly only upon acceleration from the stationary state or, if required, also upon acceleration or deceleration from a travel at constant speed, a check is made as to whether the movement signals S-51F that are determined by the first monitoring unit 42, and the changes in the movement state of the elevator car 1 that are detected by the second monitoring unit 43, are mutually coherent, a fault signal being generated in case of incoherence. The check for coherence of the measurement results determined by the two monitoring units 42, 43 can be restricted to checking an individual signal S-51F, or include the comparison of further determined kinematic information.

After detection of an acceleration or deceleration of the elevator car 11 in the second monitoring unit 43, this change in state must also be registered by the first monitoring unit 42, if the latter is functioning correctly. During fault-free operation, the measurement results of the two monitoring units 42, 43 are therefore coherent, and are either checked separately, or cross-checked against each other, to detect any faults that may occur. In the exemplary embodiment that is shown, the movement signals S-51F that are determined by the first monitoring unit 42 are transmitted to the second monitoring unit 43, where they are checked for coherence.

Conversely, also the validity of the measurement results of the second monitoring unit 43 can be checked by the first monitoring unit 42. After the detection and measurement of flank signals S-51F, it is checked whether the changes in the movement state that are detected by the second monitoring unit 43 are coherent with the flank signals. To this end, the measurement results S-43 of the second monitoring unit 43 are transmitted to the first monitoring unit 42, where they are correspondingly analyzed.

Checking of the monitoring units 42, 43 can therefore take place individually, or against each other. Through the preferably executed cross-checking, faults that can occur in the first or second sensor device 2, 31, 32, 33, or in the first or second monitoring unit 42, 43, can always be promptly detected and signaled. In a preferred embodiment, the mutual cross-checking of the two monitoring units 42, 43 takes place in a separate module 45 (see FIG. 7).

Further shown in FIG. 1 is that the monitoring apparatus 4 is preferably connected to the control unit 6 and/or to a hoistway information system 7. With the aid of the control unit 6, current operating data, for example changed maximum values for acceleration and speed, can be transmitted to the monitoring apparatus 4. Data from the hoistway information system 7 can be used to take account of the respective individual position of the elevator car 11 during the analysis of the first or second signals S51, S-31, S-32, S-33.

Figure 6:
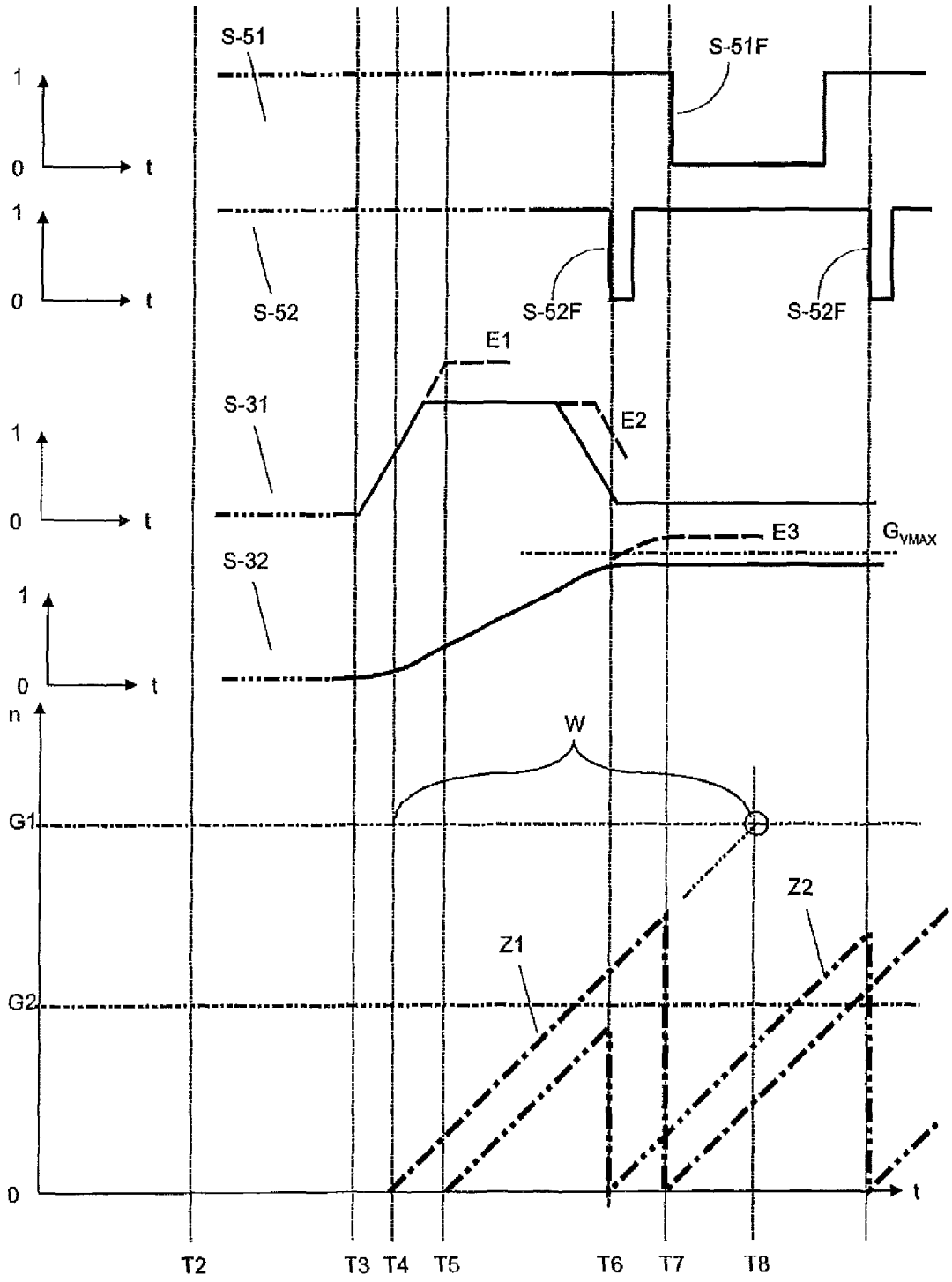
FIG. 6 is a waveform diagram whose signal pattern shows the first signals of the fork-light-barrier of FIG. 3, and second signals of an acceleration sensor, and of a speed sensor, and the pattern of corresponding counter states, which are compared with limit values to check the coherence of the measurement results of both monitoring units.

FIG. 6 shows the pattern of the signals of FIG. 5 after the instant T2. For a first consideration, it is assumed that at instant T2 the elevator car 11 was halted, and at instant T3 is accelerated again. Hence, between the instants T2 and T3, no movement signals S-51F, S-52F occur in the signal patterns S-51, S-52. Also after this instant, a movement signal S-51F, S-52F does not occur immediately, since the first and third light-barriers $LS_{MB-A1}$, $LS_{KB-A}$ are normally removed from the flanks of the markings 511, 521 of the measuring strip 5, as shown in FIG. 4.

Figure 7:
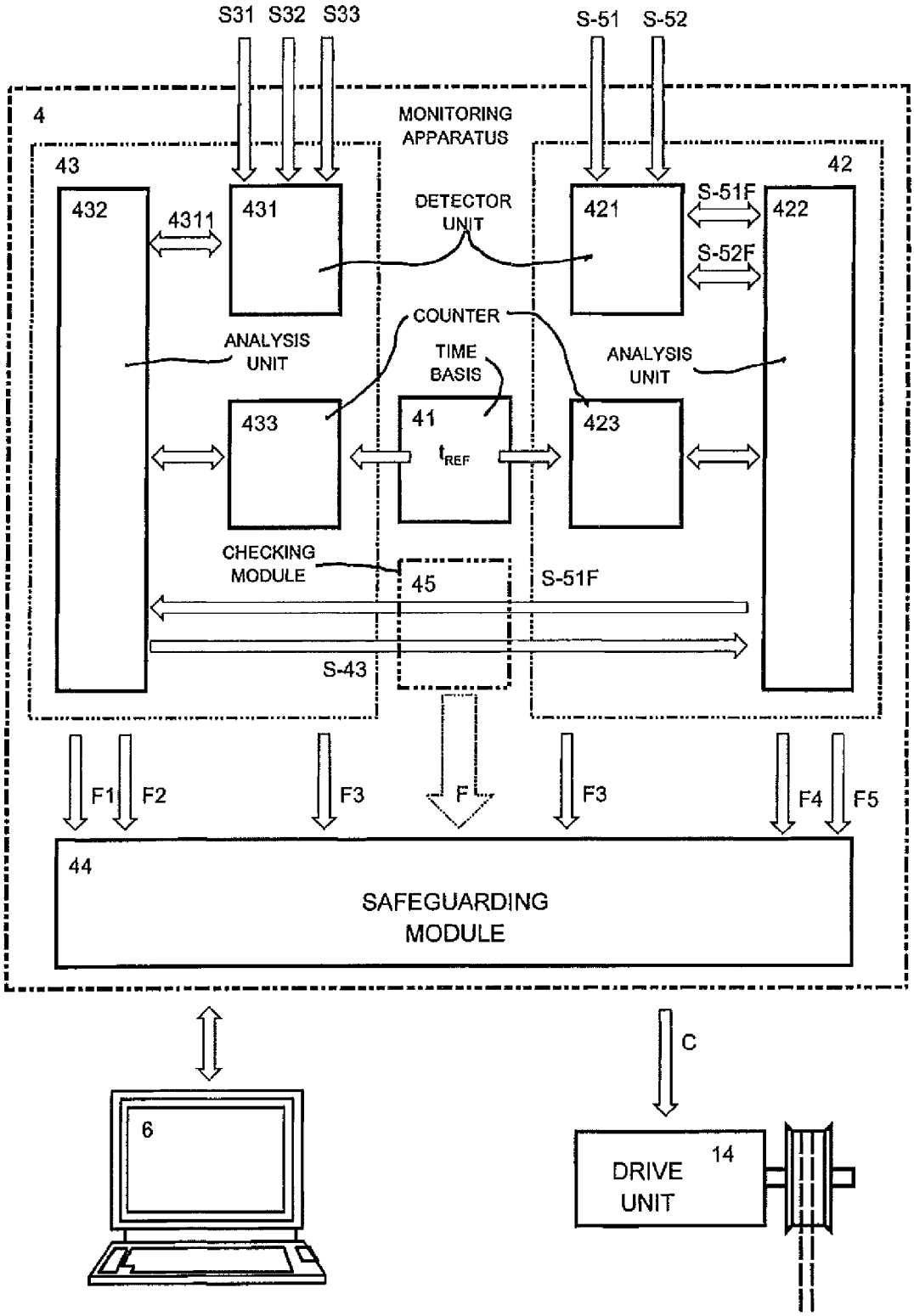
FIG. 7 is a detailed diagrammatical illustration of the monitoring apparatus of FIG. 1.

At instant T4, with the aid of the signal S-31 emitted by the acceleration sensor 31, it is detected that a change in movement, or an acceleration, of the elevator car 11 has occurred. At this instant T4 a time-window W is opened, and a check is made as to whether within this time-window W a movement signal S-51F arrives from the first monitoring unit 42 that indicates that the first light-barrier $LS_{MB-A1}$ has been opened or closed. To this end, at instant T4 a counter that is synchronized to the reference frequency $t_{REF}$ (Counter 433 in FIG. 7) is started. In consequence, the current counter value is always compared with a limit value G1, which must not be exceeded, and which, if no movement signal S-51F arrives, is reached at instant T8. On the other hand, if at instant T8 the limit value is reached, the first fault signal F1 is issued to the safeguarding module 44, as shown in FIG. 7.

However, shown in FIG. 6 is that, within the pattern of the signal S-51, already before reaching instant T8, viz. at instant T7, a movement signal S-51F, or the opening or closing of the first light-barrier $LS_{MB-A1}$, and hence the correct functioning of the first sensor device 2 and the first monitoring unit 42, has been detected. In this exemplary embodiment, after detection of the movement signal S-51F, the counter 433 is reset and restarted, so as to monitor occurrence of the next change of flank, or occurrence of the next movement signal S-51F. Simultaneous with resetting of the counter, a new time-window W is opened, within which the arrival of the next movement signal S-51F is monitored. In this preferred embodiment, monitoring is only terminated when standstill of the elevator car 11 has been detected.

Standstill of the elevator car 11 can also be detected in various known ways. If no more movement signals S-51F arrive from the first monitoring unit 42, the stationary state (standstill) of the elevator car 11 is indicated. Preferably, also in this case, the coherence of the measurement results of the first and second monitoring units 42, 43 is checked. What is checked is whether also from the second monitoring unit 43 a corresponding change of movement, or an acceleration opposite in direction to the direction of movement of the elevator car, is detected that can cause standstill of the elevator car 11. On the other hand, if the measurement results of the two monitoring units 42, 43 are not coherent, a fault signal is again emitted.

As is illustrated in FIG. 6, the coherence of various signals, events, and information can be mutually compared within individual time-windows. At instant T5, for example by reference to the signals S-32 of the speed sensor 32, a change in speed is detected. After detection of the change in speed, a second counter is started, and its value Z2 is compared with a limit value. On occurrence of a falling flank S-52F of the signals S-52, this second counter is reset.

Further shown in the diagram of FIG. 6 is a limit value G2, through which a maximum speed of the elevator car 11 is set. If the counter (see the counter 423 in FIG. 7) does not reach this limit value G2 before the former is reset, the time interval between the movement signals S-51F is too small, which means that the travel speed of the elevator car 11 is greater than the maximum speed.

Preferably, in the analysis of the signals S-31; S-32; S-33 of the second sensor device 31, 32, 33, an additional check is made as to whether impermissible operating states of the elevator 1, and in particular of the elevator car 11, prevail. If it is detected that the measured acceleration values, or speed values, lie above a limit value, or drive values lie outside a tolerance range, a fault signal F43 is generated and transmitted to the safeguarding module 44. In this embodiment of the monitoring apparatus 4 according to the invention, faulty functions, particularly overspeeds, can therefore be detected and signaled not only by the first monitoring unit 42, but also by the second monitoring unit 43.

Illustrated in FIG. 6, by reference to the pattern of the signals S-31, S-32 that are emitted from the acceleration sensor 31, and from the speed sensor 32, is that various anomalous events E1, E2, E3 can occur that are safety-relevant, and should be signaled as faults. The pattern of the signal S-31 that is emitted by the acceleration sensor 31 shows that excessively high accelerations can occur (Event El), or that an acceleration can continue for too long (Event E2), as a result of which an overspeed is to be expected. Also shown is the pattern of the signal S-32 that is emitted by the speed sensor 32, from which the exceeding of the limit value $G_{VMAX}$ for the maximum speed can be directly read off.

FIG. 7 shows a detailed function flow chart of the monitoring apparatus 4 of FIG. 1 with the first monitoring unit 42, to which signals S-51, S-52 from the first sensor device 2 are transmitted, and of the second monitoring unit 43, to which signals S-31, S-32, S-33 from the acceleration sensor 31, from the speed sensor 32, and from the measurement-value transducer 33 are transmitted. The two monitoring units 42, 43, to which frequency signals $t_{REF}$ are transmitted from a commonly used time base 41, analyze the transmitted signals S-51, S-52; S-31, S-32, S-33, as well as the signals S-51F, S-43 that are exchanged between the two monitoring units 42, 43 and, after the detection of anomalies, transmit corresponding fault signals or fault messages F1, . . . , F5 to the safeguarding module 44, which transmits corresponding control signals C to the drive apparatus 14, and corresponding information to the control unit 6.

The first signals S-51, S-52 that are emitted by the first sensor device 2 are, in the first monitoring unit 42, fed to a flank detector 421, which transmits movement signals, or flank signals, S-51F, S-52F to an analysis unit 422. With the aid of a counter 423, the time intervals of the occurrences of movement signals S-51 F, S-52F are checked by the analysis unit 422, to detect whether these time intervals lie below a limit value (see limit value G2 in FIG. 6), which is chosen according to the maximum permissible speed. Further, events, movement information, or also only individual movement signals S-51F, that are detected by the analysis unit 422, are passed on to the second monitoring unit 43.

In the second monitoring unit 43, the second signals S-31, S-32, S-33 that are emitted by the acceleration sensor 31, by the speed sensor 32, and by the measurement-value transducer 33 are fed to a detector unit 431, which transmits relevant movement changes and state changes to an analysis unit 432. The analysis unit 432 checks whether the detected movement changes and state changes lie within the defined limit values and tolerance ranges. Further, the analysis unit 432 checks whether the detected movement-changes and state-changes are coherent with the events, movement information, and movement signals S-51F that are signaled by the first monitoring unit 42. Since the events, information items, and signals that are detected in the first and second monitoring units 42, 43 typically do not occur simultaneously, a counter unit 433 is provided through which a time-window W is defined, within which is checked whether the mutually corresponding events, information, and signals occur, and the first and second monitoring units 42, 43 operate coherently. The counter unit 433 is activated by the analysis unit 432 in response to a signal 4311 from the detector unit 431.

Further shown in FIG. 6 is that, by means of a message S-43, the movement changes and state changes that are detected by the second monitoring unit 43 are also signaled to the first monitoring unit 42, which then checks whether the signaled movement changes and state changes are coherent with its own measurement values. In this manner, also a faulty function that has occurred in the second sensor device 31, 32, 33, or in the second monitoring unit 43, can be detected.

In a preferred embodiment, checking the coherence of the measurement results of the two monitoring units 42, 43 is performed in a separate checking module 45 which transmits a fault signal or fault message F to the safeguarding module 44, which In this manner, a simplified modular structure, which can be extended at will, results. When checking the notified measurement results for coherence, through the checking module 45 further data can be taken into account which, for example, are notified by at least one further monitoring unit, or by the control unit 6.

With knowledge of the present invention, the elevator specialist can change the set forms and arrangements at will. In particular, any type of sensor device can be used whose use allows kinematic parameters to be registered. The solution according to the invention is scalable at will, and can also additionally take account of further information, for example information from the hoistway information system, and thereby be adapted to the respective requirements of the user. In the examples, the use is shown of an acceleration sensor 31, speed sensor 32, and measurement-value transducer 33, for second signals S-31, S-32, S-33. Self-evidently, the elevator specialist can use these different sensors either in combination or individually.

The first and/or the second sensor device 2, 31, 32, 33, and/or the first and the second monitoring unit 42, 43, can also be selectively integrated in a common housing, or in a common measurement body, so that a single function unit is formed, Shown in FIG. 2 is that the fork-light-barrier 2 has not only optical elements 21A, 22A; 23A, 24A; 21B, 22B; 23B, 24B; 25A, 26A; 25B, 26B for realization of the light-barriers $LS_{MB-A1}$, $LS_{MB-B1}$; $LS_{MB-A2}$, $LS_{MB-B2}$, $LS_{KB-A}$, $LS_{KB-B}$, but also an acceleration sensor 31A for a first channel, and an acceleration sensor 31B for a preferably provided second channel, which in their entirety are integrated in the body 28 of the fork-light-barrier 2. Further, also the first and/or the second monitoring unit 42, 43 can be integrated in the body 28 of the fork-light-barrier 2.

Since the acceleration sensor 31 contains in one housing all of the elements that are required to measure the acceleration, in particular the test mass, its use in combination with a freely embodied first sensor device 2, in particular a fork-light-barrier, is particularly advantageous. Integration of the acceleration sensor 31 in the fork-light-barrier 2 requires virtually no additional space. Preferably, the acceleration sensor 31 is cast in the body 28 of the first sensor device 2, and thereby optimally protected. Through the combination of the first and the second sensor devices 2, 31, a complete sensor unit is provided, which can monitor itself, and which, for this purpose, does not require any further information to be supplied from outside.

Already with use of an acceleration sensor 31, a significant increase in the reliability of the apparatus is achieved. The speed sensor 32, and the measurement-value transducer 33, can additionally be used, should a further increase in the reliability of the measurement results be desired. Further, the speed sensor 32, and/or the measurement-value transducer 33, can also be used as an alternative to the acceleration sensor 31. As stated, the first and/or the second sensor device 2, 31, 32, 33 can be constructed single-channel or multi-channel.

FIG. 7 therefore shows only one exemplary embodiment, in which only the possibility of using a plurality of sensors 31, 32, 33 for the second sensor device is shown. In the practical application, at least one of the said sensors 31, 32, or 33 is present.

In a further preferred embodiment, at least the second monitoring unit 43 has a filter phase, by means of which anomalies that could cause false alarms are eliminated. By means of the filter phase, which is integrated, for example, in the detector unit 431, particularly signals are suppressed that, for example, are attributable to irrelevant vibrations.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for determining a movement and/or a position of an elevator car of an elevator system with a first monitoring unit for analyzing first signals of a first sensor device to obtain information about the movement and/or the position of the elevator car, and to detect any occurrence of faulty behavior of the elevator system, and to initiate corresponding safety measures, and with a second sensor device, which does not operate on the principle of the first sensor device, for registering a change of the movement state of the elevator car and emitting corresponding second signals to a second monitoring unit, which second monitoring unit analyzes the second signals and detects an occurrence of a change of the movement state of the elevator car, comprising the steps of:

a. determining an instant of a change in the movement state of the elevator car with the second monitoring unit;

b. monitoring the occurrence of at least one of a first movement signal or a function signal generated by the first monitoring unit within at least one time-window that follows the instant of change; and c. generating a first fault signal should the first movement signal or the function signal, which indicates coherent functioning of the first monitoring unit, not occur within the time-window.

2. The method according to claim 1 wherein the second sensor device includes at least one electromechanical movement sensor that is connected to at least one of a drive apparatus and a brake apparatus of the elevator for performing step a. by registering a change in the movement state of the elevator car as at least one of a change in acceleration and a change in speed.

3. The method according to claim 2 wherein the at least one electromechanical movement sensor is one of an acceleration sensor, a speed sensor, and a measurement transducer.

4. The method according to claim 2 including analyzing the first signals emitted by the first sensor device to determine a speed or a possible overspeed of the elevator car, analyzing the second signals emitted by the movement sensor to determine impermissible operating states, and generating a second fault signal upon detection of values of the first and second signals that lie above a limit value or outside a tolerance range.

5. The method according to claim 4 wherein the impermissible operating states include acceleration values lying above a limit value, speed values lying above a limit value, and drive parameters lying outside a tolerance range.

6. The method according to claim 1 wherein the second monitoring unit includes a detector unit and a counter unit connect to an analysis unit, and including transmitting the second signals of the second sensor device to the detector unit which detects the change of the movement state of the elevator car and signals that change to the analysis unit, which, on reception of the signal from the detector unit, activates the counter unit and, within the time-window that is measured by the counter unit, monitors the first monitoring unit for the first movement signal or the function signal and, should the first movement signal fail to arrive, generates the first fault signal to a safeguarding module.

7. The method according to claim 1 wherein monitoring of coherence of the first and second monitoring units is terminated only on detection of a standstill of the elevator car, which, after taking into account the detection of corresponding movement changes including an acceleration opposite in direction to a direction of movement of the elevator car, is verified in the second monitoring unit.

8. The method according to claim 1 including upon detection of movement changes in one of the first and second monitoring units, correspondingly adjusting a size of the time-window within which a coherent confirmation of the change in movement of another of the first and second monitoring units is expected.

9. The method according to claim 1 wherein the first sensor device is a light-barrier apparatus which is mounted on the elevator car and has first optical elements that form a first light-barrier, and including scanning markings of a measuring track of a stationarily mounted measuring strip with the first light-barrier to generate corresponding one of the first signals from which the first monitoring unit generates the first movement signal.

10. The method according to claim 9 wherein the light-barrier apparatus has two optical elements that form a second light-barrier, and including scanning markings of a monitoring track of the measuring strip with the second light-barrier to generate further ones of the first signals from which the first monitoring unit generates second movement signals.

11. The method according to claim 10 wherein the first monitoring unit contains a flank detector, and including determining by reference to the first signals status changes of the first and second light-barriers with the flank detector and transmitting the corresponding first and second movement signals to the second monitoring unit and to an analysis unit, activating a counter unit with the analysis unit after receipt of one of the first movement signals that is caused by the measuring track and checking whether, before receipt of a following one of the first movement signals, a defined counter value is exceeded.

12. The method according to claim 11 wherein when the defined counter value is fallen below, generating a fault signal and sending the fault signal to a safeguarding module, and upon failure of the second movement signals to occur, generating another fifth fault signal and sending the another fault signal to the safeguarding module.

13. The method according to claim 9 wherein depending on a distance between the markings of the measuring track, using a control track or a safeguarding track of the measuring strip with the first light-barrier to generate the corresponding one of the first signals from which the first monitoring unit generates the first movement signal.

14. An apparatus for determining a movement and/or a position of an elevator car of an elevator system comprising:

a first monitoring unit connected to a first sensor device for analyzing first signals from the first sensor device for obtaining information about the movement and/or position of the elevator car and for detecting a faulty behavior of the elevator system and initiating corresponding safety measures;

a second monitoring unit connected to a second sensor device, which second sensor device does not operate on the principle of the first sensor device, the second sensor device registering changes of a movement state of the elevator car and generating corresponding second signals to the second monitoring unit for analyzing the second signals;

a checking module connected to the first and second monitoring units for checking whether the movement signals that are determined by the first monitoring unit and the changes of the movement state of the elevator car that are detected by the second monitoring unit are mutually coherent, and in response to incoherence, generating a first fault signal; and a time basis connected to the first and second monitoring units for establishing a time-window during which the mutual coherence is checked by the checking module.

15. The apparatus according to claim 14 wherein the first sensor device is a light-barrier apparatus which is mounted on the elevator car and has first optical elements forming a first light-barrier for scanning markings of a measuring track of a stationarily mounted measuring strip and, the light-barrier apparatus has second optical elements forming a second light-barrier for scanning markings of a control track of the measuring strip.

16. The apparatus according to claim 14 wherein the second sensor device contains at least one electromechanical movement sensor that is connected to at least one of a drive apparatus and a brake apparatus of the elevator system by which changes of the movement state of the elevator car are registered.

17. The apparatus according to claim 16 wherein the electromechanical movement sensor is one of an acceleration sensor, a speed sensor, and a measurement-value transducer.

18. The apparatus according to claim 16 wherein the changes include at least one of changes of an acceleration, changes of a speed, and corresponding causes in the drive apparatus or the brake apparatus.

19. Apparatus according to claim 14 wherein the first sensor device and at least a part of the second sensor device are arranged in a common housing.

20. An elevator system comprising:

an elevator car;

a first monitoring unit connected to a first sensor device for analyzing first signals from the first sensor device for obtaining information about movement and/or position of the elevator car and for detecting a faulty behavior of the elevator system and initiating corresponding safety measures;

a second monitoring unit connected to a second sensor device, which second sensor device does not operate on the principle of the first sensor device, the second sensor device registering changes of a movement state of the elevator car and generating corresponding second signals to the second monitoring unit for analyzing the second signals;

a checking module connected to the first and second monitoring units for checking whether the movement signals that are determined by the first monitoring unit and the changes of the movement state of the elevator car that are detected by the second monitoring unit are mutually coherent, and in response to incoherence, generating a first fault signal;

a time basis connected to the first and second monitoring units for establishing a time-window during which the mutual coherence is checked by the checking module; and at least one of a central control unit and a hoistway information system being connected to at least one of the first and second monitoring units for receiving at least one of position data and movement information of the elevator car.

* * * * *